US006238109B1

(12) United States Patent
Minami

(10) Patent No.: US 6,238,109 B1
(45) Date of Patent: May 29, 2001

(54) PROCESSING SOLUTION SUPPLY APPARATUS

(75) Inventor: Tomohide Minami, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/608,010

(22) Filed: Jun. 30, 2000

(30) Foreign Application Priority Data

Jul. 2, 1999 (JP) ..... 11-189008

(51) Int. Cl.[7] ..... G03D 5/00

(52) U.S. Cl. ..... 396/604; 396/611; 396/626; 118/52; 427/240

(58) Field of Search ..... 396/604, 611, 396/626, 627; 118/54, 56, 319–321, 500, 667, 716; 427/240, 229; 134/3, 4, 902, 34; 430/30, 319, 327

(56) References Cited

U.S. PATENT DOCUMENTS 5,374,312 * 12/1994 Hasebe et al. ..... 118/52

5,866,307 * 2/1999 Kiba et al. ..... 430/327

FOREIGN PATENT DOCUMENTS 4-196517 7/1992 (JP) .

* cited by examiner

*Primary Examiner*—D. Rutledge

(74) *Attorney, Agent, or Firm*—Oblon, Spivak, McClelland, Maier & Neustadt, P.C.

(57) ABSTRACT

A circulating path from a supply pipe to a filter, from the filter through a vent pipe, returning to the supply pipe is formed, and a first three-way valve is provided at the vent pipe. On the other hand, a circulating path from the supply pipe to a discharge pump, from the discharge pump through a purge pipe, returning to the supply pipe is formed, and a second three-way valve is provided at the purge pipe. The first three-way valve and the second three-way valve are switched, thereby performing an operation of removal of bubbles in the piping.

17 Claims, 13 Drawing Sheets

PROCESSING SOLUTION SUPPLY APPARATUS

CROSS-REFERENCE TO RELATED APPLICATIONS

This application is based upon and claims the benefit of priority from the prior Japanese Patent Application No. 11-189008, filed Jul. 2, 1999, the entire contents of which are incorporated herein by reference.

BACKGROUND OF THE INVENTION

The present invention relates to a semiconductor processing apparatus, more specifically, to a processing solution supply apparatus for supplying a processing solution onto a substrate to be processed such as a semiconductor wafer or the like.

Conventionally, in a processing solution supply apparatus for supplying a processing solution onto a substrate to be processed, a container storing the processing solution and a nozzle placed near the substrate to be processed are connected with each other by a supply pipe, so that the processing solution stored in the container is sent to the nozzle by a pump which is provided at a midpoint in the supply pipe.

FIG. 14 is a schematic diagram of a processing solution supply system used in a conventional-type processing solution supply apparatus.

As shown in FIG. 14, in a processing solution supply system 214, a processing solution tank 201, a liquid end sensor 203, a supply pump 204, a filter 205, a discharge pump 206, and a nozzle 202 are stacked in this order, and these adjoining components are connected with each other by a supply pipe 207. To the filter 205 attached is a vent pipe 208 leading to a waste solution tank (not shown).

A purge pipe 209 is attached to the discharge pump 206 on the downstream side in a direction of movement of the processing solution. This purge pipe 209 is connected to a T-shape branch pipe 213 which is attached to a supply pipe 207*b* between the processing solution tank 201 and the liquid end sensor 203 so as to allow the processing solution which has passed through the purge pipe 209 to join the supply pipe 207*b*.

By the way, in the processing solution supply system 214 having a configuration in which the processing solution tank 201 and the nozzle 202 are linked together by the long supply pipe 207 as shown in FIG. 14, bubbles often form in the supply pipe 207, and if the bubbles are left as they are, the amount of the processing solution discharged from the nozzle 202 onto the substrate to be processed, such as a wafer, varies, resulting in a danger of reducing quality of the wafer. Therefore, the processing solution supply system 214 shown in FIG. 14 includes a bubble-removing mechanism.

More specifically, in the case where air enters in the supply pipe 207 such as the case where a processing solution is newly poured into the processing solution tank 201 and the case where a filter module in the filter 205 is exchanged for another and the processing solution is newly allowed to flow, the supply pump 204 is operated in the state where a vent valve 211 of the vent pipe 208 is opened at the time of start of the supply of the processing solution to send the processing solution which is pumped up from the processing solution tank 201 to the filter 205. Into the filter 205, a processing solution containing a large amount of bubbles is first sent, the amount of bubbles gradually decreasing, and finally a processing solution without bubbles is supplied. For this reason, the processing solution containing bubbles is disposed of to a waste solution tank (not shown) through the vent pipe 208.

Here, there is a disadvantage that the processing solution is all disposed of when the supply pump 204 is started with the vent valve 211 being opened, resulting in a big waste of the processing solution.

Further, bubbles often form in the supply pipe 207 also during the normal operation of discharging the processing solution from the nozzle 202 onto the wafer W, and in that case, a purge valve 212 of the purge pipe 209 which is connected to the discharge side of the discharge pump 206 is opened to send the processing solution containing bubbles to the purge pipe 209 side.

However, since the purge pipe 209 is connected to the T-shape branch pipe 213 provided at the supply pipe 207*b* between the processing solution tank 201 and the liquid end sensor 203, there is a disadvantage that the processing solution containing bubbles recirculates in the supply pipe 207, thereby interfering the supply of an accurate amount of the processing solution.

BRIEF SUMMARY OF THE INVENTION

It is an object of the present invention to provide a processing solution supply apparatus capable of eliminating waste of a processing solution.

Moreover, it is another object of the present invention to provide a processing solution supply apparatus capable of effectively remove bubbles.

To solve the above disadvantages, a processing solution supply apparatus of the present invention comprises a discharge unit configured to discharge a processing solution onto a substrate to be processed, a processing solution supply source configured to store the processing solution, a supply pipe configured to link the discharge means and the processing solution supply source, a pump provided at the supply pipe, a control unit configured to control operation of the pump, a branch pipe provided at a pipe between the processing solution supply source and the pump, a by-pass pipe configured to link the branch pipe and the pump, a three-way valve provided at the by-pass pipe and configured to allow the pump to communicate with the branch pipe or a waste solution pipe, and a switch unit configured to switch the three-way valve.

In the aforesaid processing solution supply apparatus, the discharge unit is a nozzle for discharging the processing solution onto, for example, a wafer W. The processing solution supply source is, for example, a processing solution tank configured to store the processing solution. The supply pipe is a pipe configured to supply the processing solution from the processing solution supply source to the discharge unit, and a pipe configured to link various kinds components such as a liquid end sensor, a supply pump, a filter, and a discharge pump which are provided at a midpoint therein. The pump is, for example, one or both of a supply pump and a discharge pump. The control unit for controlling operation of the pump is a controller which controls operation of, for example, the supply pump and the discharge pump. The branch pipe is, for example, a T-shape branch pipe for connecting the supply pipe and a purge pipe, or a cross branch pipe for connecting the supply pipe, and the purge pipe and a vent pipe. The by-pass pipe is a pipe except for the supply pipe and, for example, one or both of the purge pipe and the vent pipe.

The three-way valve is, for example, a valve provided with one input side and two output sides and capable of switching a connection between one of the two output sides and one input side. The switch unit for switching the three-way valve is, for example, a switch for switching the three-way valve by a mechanical or electrical method such as a solenoid.

In the processing solution supply apparatus of the present invention, it is suitable that the vent pipe and the supply pipe are configured to communicate together via a T-shape branch pipe or a cross branch pipe and a three-way valve is provided at a midpoint in the vent pipe to switch the vent pipe to communicate with a waste solution tank or the supply pipe.

Moreover, in the processing solution supply apparatus of the present invention, it is suitable that the purge pipe and the supply pipe are configured to communicate together via a T-shape branch pipe or a cross branch pipe and a three-way valve is provided at a midpoint in the purge pipe to switch the purge pipe to communicate with a waste solution tank or the supply pipe.

Furthermore, the vent pipe, the purge pipe, and the supply pipe are configured to communicate together via the cross branch pipe as described above, three-way valves are provided at the vent pipe and the purge pipe respectively to dispose of a processing solution containing bubbles to the waste solution tank from any of the vent pipe and the purge pipe.

It is also suitable that a control unit for controlling the three-way valves is further provided and the three-way valves are periodically operated to dispose of the processing solution containing bubbles from the vent pipe or the purge pipe. Further, a sensor for detecting the existence of bubbles is attached at a midpoint in the supply pipe and the three-way valves are operated when bubbles appear in the processing solution system to dispose of the processing solution containing bubbles from the vent pipe or the purge pipe.

In this processing solution supply apparatus, while the vent pipe and the purge pipe, and the supply pipe are made communicate together, the three-way valves are provided at the vent pipe and the purge pipe, thereby disposing of only the processing solution containing bubbles by switching the three-way valves when required. Accordingly, almost all wasteful disposal of the processing solution can be prevented, and the processing solution containing bubbles never recirculates, so that the discharge amount of the processing solution can be accurately controlled.

Moreover, another processing solution supply apparatus of the present invention comprises a discharge unit configured to discharge a processing solution onto a substrate, a processing solution supply source configured to store the processing solution, a supply pipe configured to link the discharge means and the processing solution supply source, a pump configured to supply the processing solution from the processing solution supply source to the discharge unit, a filter inserted in a supply pipe between the pump and the discharge means, a by-pass pipe configured to link the filter and a supply pipe on the upstream side of the pump, a waste solution pipe branching out from the by-pass pipe, and a switching valve configured to switch the processing solution in the by-pass pipe either to the upstream side of the pump or the waste solution pipe.

In the above processing solution supply apparatus, the by-pass pipe may link the pump and the supply pipe. Further, it is suitable that two by-pass pipes are used and one of the by-pass pipes links the filter and the supply pipe together, and the other by-pass pipe links the pump and the supply pipe together.

Furthermore, the switching valve may be driven at predetermined timing.

In the above processing solution supply apparatus, the by-pass pipe for linking the supply pipe, and the filter and the pump is provided in addition to the supply pipe, and the waste solution pipe is provided at the by-pass pipe with the switching valve therebetween, so that bubbles in the piping can be efficiently removed by switching the switching valve at appropriate timing.

Further, a third processing solution supply apparatus of the present invention comprises a discharge unit configured to discharge a processing solution onto a substrate, a processing solution supply source configured to store the processing solution, a supply pipe configured to link the discharge unit and the processing solution supply source, a pump provided at the supply pipe, a control unit configured to control operation of the pump, a branch pipe provided at a supply pipe between the processing solution supply source and the pump, a by-pass pipe configured to link the pump and the branch pipe, a return pipe branching out from the by-pass pipe, for linking between the by-pass pipe and the processing solution supply source, a first three-way valve provided at the by-pass pipe and configured to allow the pump to communicate with the by-pass pipe or the return pipe, a switch unit configured to switch the first three-way valve, a second three-way valve provided between the first three-way valve and the branch pipe and configured to allow the first three-way valve to communicate with the by-pass pipe or a waste solution pipe, and a switch unit configured to switch the second three-way valve.

In this processing solution supply apparatus, since the processing solution containing bubbles which exist in the supply pipe of the apparatus can be all returned to the processing solution supply source though the return pipe, so that wasteful disposal of the processing solution can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (First Embodiment)

Hereinafter, preferred embodiments of the present invention will be explained in detail with reference to the drawings.

Figure 1:
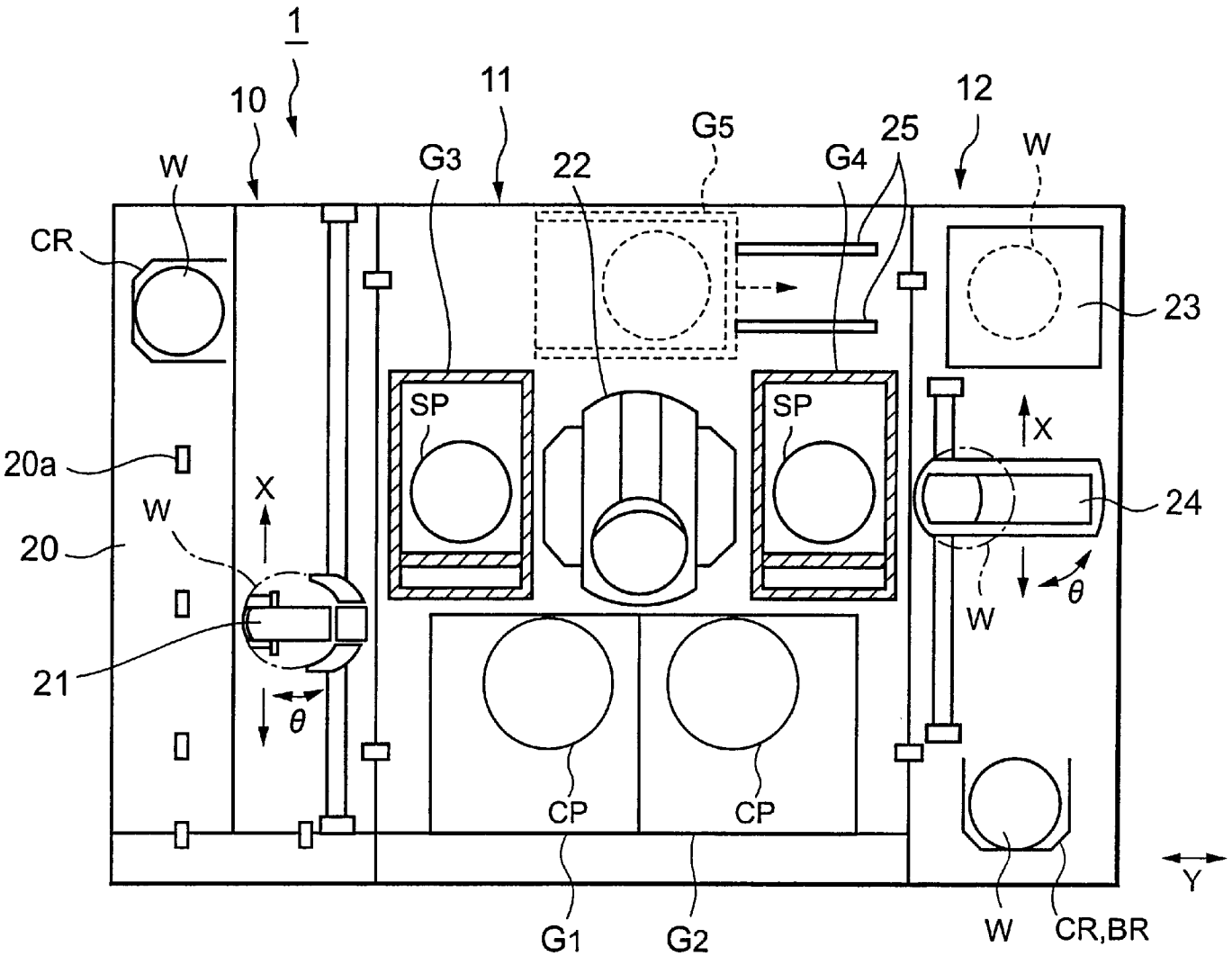
FIG. 1 is a plane view of a coating and developing processing system including a resist coating unit according to an embodiment of the present invention.

FIG. 1 is a plane view showing an entire coating and developing system 1 for a semiconductor wafer (hereinafter, referred to as "wafer") W including a resist coating unit (COT) according to an embodiment of the present invention.

In the coating and developing system 1, a cassette station 10 for carrying a plurality of, for example, 25 wafers W as objects to be processed, as a unit, in a wafer cassette CR, from/to the outside into/from the system and carrying the wafers W into/out of a wafer cassette CR, and a processing station 11 in which various kinds of processing units for performing predetermined processing for the wafers W one by one in the coating and developing process are stacked at multi-stages at predetermined positions, and an interface section 12 for delivering the wafer W to/from an aligner (not shown) provided adjacent to the processing station 11, are integrally connected. In this cassette station 10, a plurality of, for example, up to four wafer cassettes CR are mounted in a line in an X-direction (in a vertical direction in FIG. 1) with respective wafer ports facing the processing station 11 side at positions of positioning projections 20*a* on a cassette mounting table 20, and a wafer transfer body 21 movable in the direction of arrangement of the cassettes (the X-direction) and in the direction of arrangement of the wafers W housed in the wafer cassettes CR (the Z-direction; a vertical direction) selectively gets access to any of the wafer cassettes CR.

The wafer transfer body 21 is rotatable in a θ-direction so that it is accessible also to an alignment unit (ALIM) and an extension unit (EXT) which are placed in a multi-tiered unit section of a third processing unit group G3 on the processing station 11 side as will be described later.

In the processing station 11, a vertical transfer-type main arm 22 including a wafer transfer machine is provided, and all processing units composing one group or a plurality of groups are stacked at multi-stages around the main arm 22.

Figure 2:
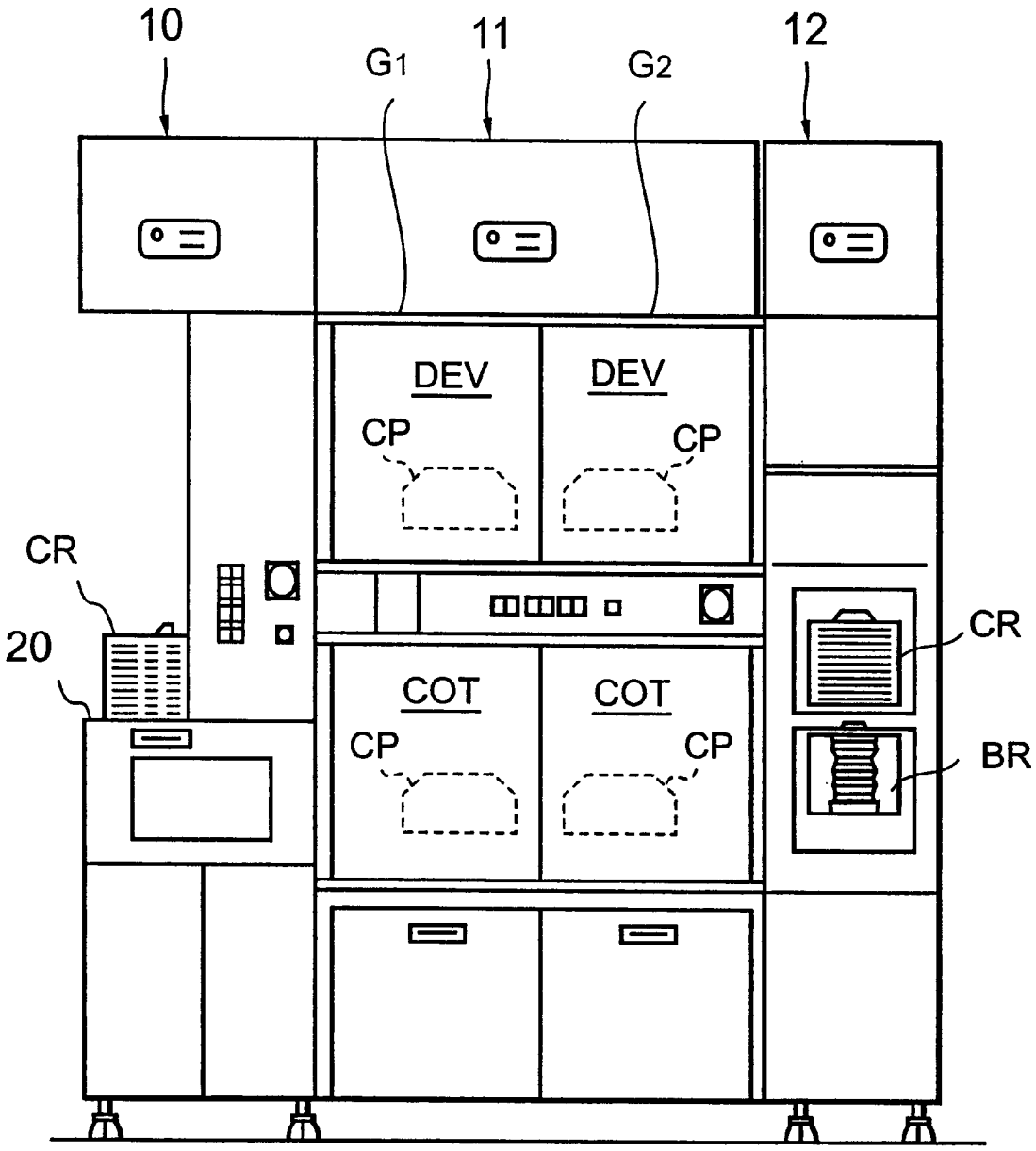
FIG. 2 is a front view of the coating and developing processing system including the resist coating unit according to the embodiment of the present invention.

FIG. 2 is a front view of the coating and developing system 1.

In the first processing unit group G1, two spinner-type processing units in which the wafer W is mounted on a spin chuck inside a cup CP to undergo predetermined processing, for example, a resist coating unit (COT) and a developing unit (DEV) are stacked at two stages from the bottom in order. In the second processing unit group G2, two spinner-type processing units, for example, a resist coating unit (COT) and a developing unit (DEV) are stacked at two stages from the bottom in order. It is preferable to place the resist coating units (COT) on the lower stage side as above because drainage of a resist solution is complex in terms of both mechanism and maintenance. It is possible, however, to arrange the resist coating units (COT) on the upper tier as required.

Figure 3:
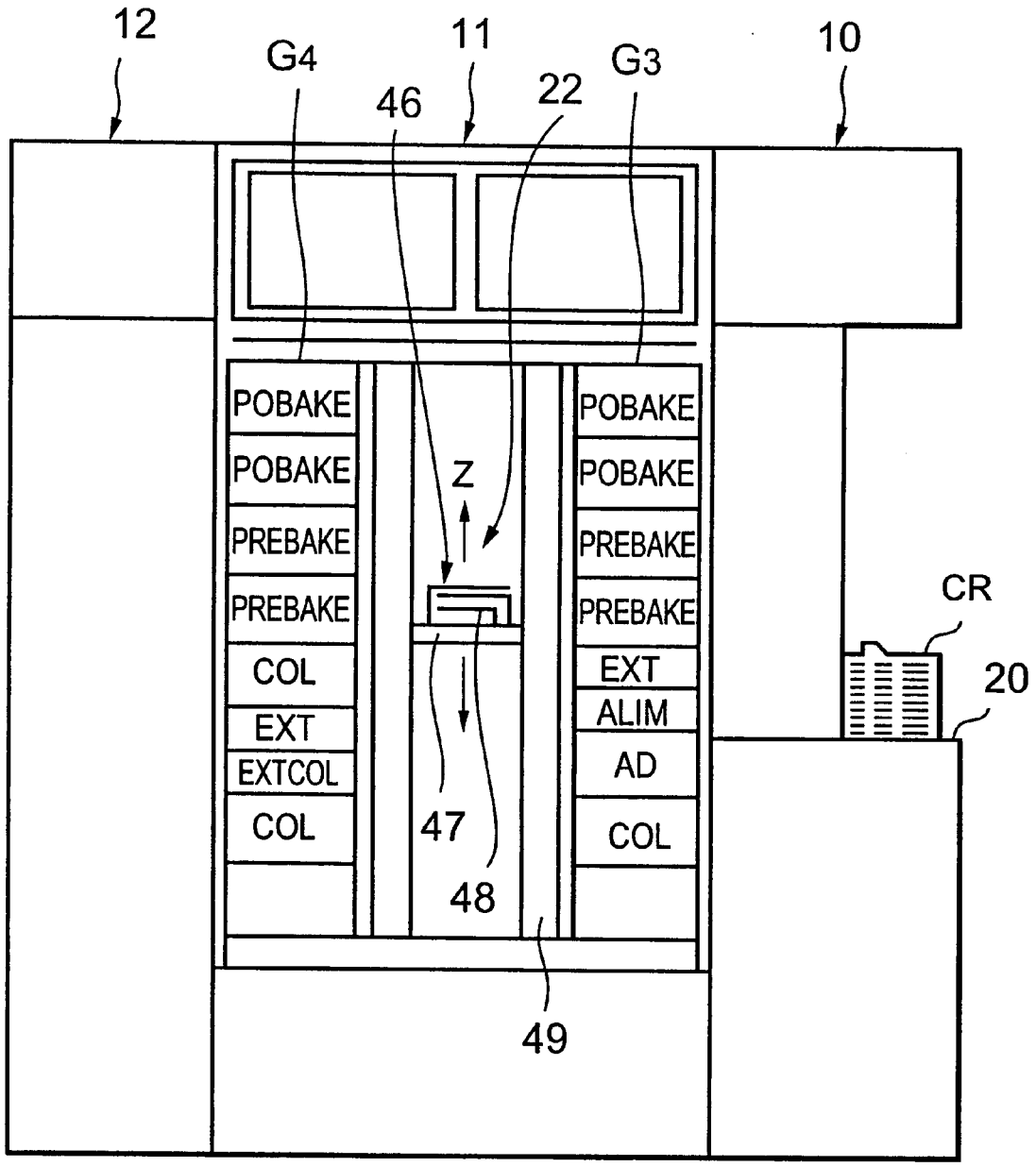
FIG. 3 is a rear view of the coating and developing processing system including the resist coating unit according to the embodiment of the present invention.

FIG. 3 is a rear view of the coating and developing system 1.

The main arm 22 is provided with a wafer transfer machine 46 which is ascendable and descendable in the vertical direction (the Z-direction) inside a cylindrical supporter 49. The cylindrical supporter 49 is connected to a rotating shaft of a motor (not shown) and rotates integrally with the wafer transfer machine 46 around the aforesaid rotating shaft by rotational driving force of the motor. Accordingly, the wafer transfer machine 46 is rotatable in the θ-direction. Incidentally, cylindrical supporter 49 may be connected to another rotating shaft (not shown) rotated by the motor.

The wafer transfer machine 46 includes a plurality of holding members 48 which are movable in a forward and rearward direction of a transfer base 47. The holding members 48 realizes delivery of the wafer W between the processing units.

As shown in FIG. 1, five processing unit groups G1, G2, G3, G4 and G5 can be arranged in the coating and developing system 1. The multi-stage units of the first and second processing unit groups G1 and G2 are arranged on the front side the system (on the lower side in FIG. 1), the multi-stage units of the third processing unit group G3 are arranged adjacent to the cassette station 10, the multi-stage units of the fourth processing unit group G4 are arranged adjacent to the interface section 12, and the multi-stage units of the fifth processing unit group G5 can be arranged on the rear side.

As shown in FIG. 3, in the third processing unit group G3, oven-type processing units in each of which the wafer W is placed on a holding table (not shown) to undergo predetermined processing, for example, a cooling unit (COL) for performing cooling processing, an adhesion unit (AD) for performing so-called hydrophobic processing to enhance fixedness of the resist, an alignment unit (ALIM) for performing alignment, an extension unit (EXT), prebaking units (PREBAKE) for performing heat processing before exposure processing, and postbaking units (POBAKE) for performing heat processing after exposure processing are, for example, eight-tiered from the bottom in order. Similarly, in the fourth processing unit group G4, oven-type processing units, for example, a cooling unit (COL), an extension and cooling unit (EXTCOL), an extension unit (EXT), a cooling unit (COL), prebaking units (PREBAKE), and postbaking units (POBAKE) are stacked at, for example, eight stages from the bottom in order.

The above arrangement of the cooling unit (COL) and the extension and cooling unit (EXTCOL) having low processing temperature at the lower tiers and the prebaking unit (PREBAKE), the postbaking unit (POBAKE), and the adhesion unit (AD) having high processing temperature at the upper tiers, can reduce thermal mutual interference between the units. Random multi-stage arrangement is naturally suitable.

The interface section 12 has the same length as the processing station 11 in a depth direction (the X-direction) but has a smaller size in a width direction (the Y-direction) as shown in FIG. 1. A transportable pickup cassette CR and a fixed-type buffer cassette BR are stacked at two stages at the front of the interface section 12, an edge aligner 23 is placed at the rear, and a wafer transfer body 24 is further placed at the center. The wafer transfer body 24 moves in the X-direction and the Z-direction to get access to both the cassettes CR and BR, and the edge aligner 23.

The wafer transfer body 24 is rotatable in the θ-direction to be accessible to the extension unit (EXT) placed in the multi-stage units of the fourth processing unit group G4 on the processing station 11 side and also to a wafer delivery table (not shown) on the adjacent aligner side.

It should be noted that in the coating and developing system 1, the multi-stage units of the fifth processing unit group G5 shown by a broken line in FIG. 1 can be placed on the rear side of the main arm 22 as described above. The multi-stage units of the fifth processing unit group G5 can be moved along guide rails 25. Accordingly, even in the case where the multi-stage units of the fifth processing section G5 are provided as shown in FIG. 1, a space portion is obtained by sliding the fifth processing section G5 along the guide rails 25, so that maintenance operation for the main arm 22 can be easily performed from the back thereof.

Figure 4:
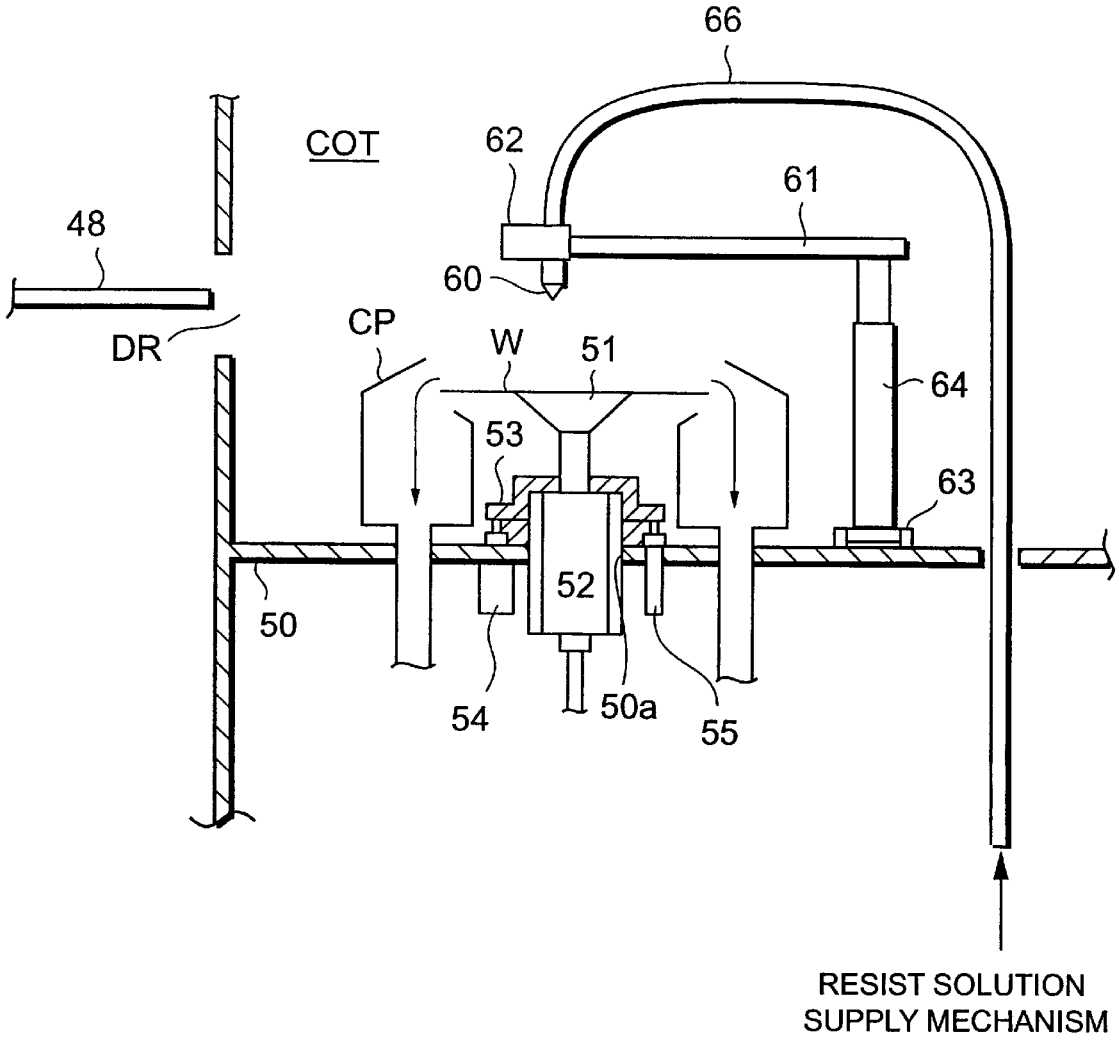
FIG. 4 is a schematic sectional view of the resist coating unit according to the present embodiment.

Next, the resist coating unit (COT) according to this embodiment is explained. FIG. 4 is a schematic sectional view of the resist coating unit (COT) according to this embodiment. An annular cup CP is placed in the central portion of the resist coating unit (COT), and a spin chuck 51 is placed inside the cup CP. The spin chuck 51 is rotationally driven by a drive motor 52 while securely holding a wafer w by vacuum adherence.

The drive motor 52 is placed in an opening 50*a* provided in a unit bottom plate 50 to be ascendable and descendable, and is linked together with an ascent/descent drive unit 54 composed of, for example, an air cylinder and an ascent/descent guide member 55 through the medium of a flange member 53 in cap form made of, for example, aluminum.

Figure 5:
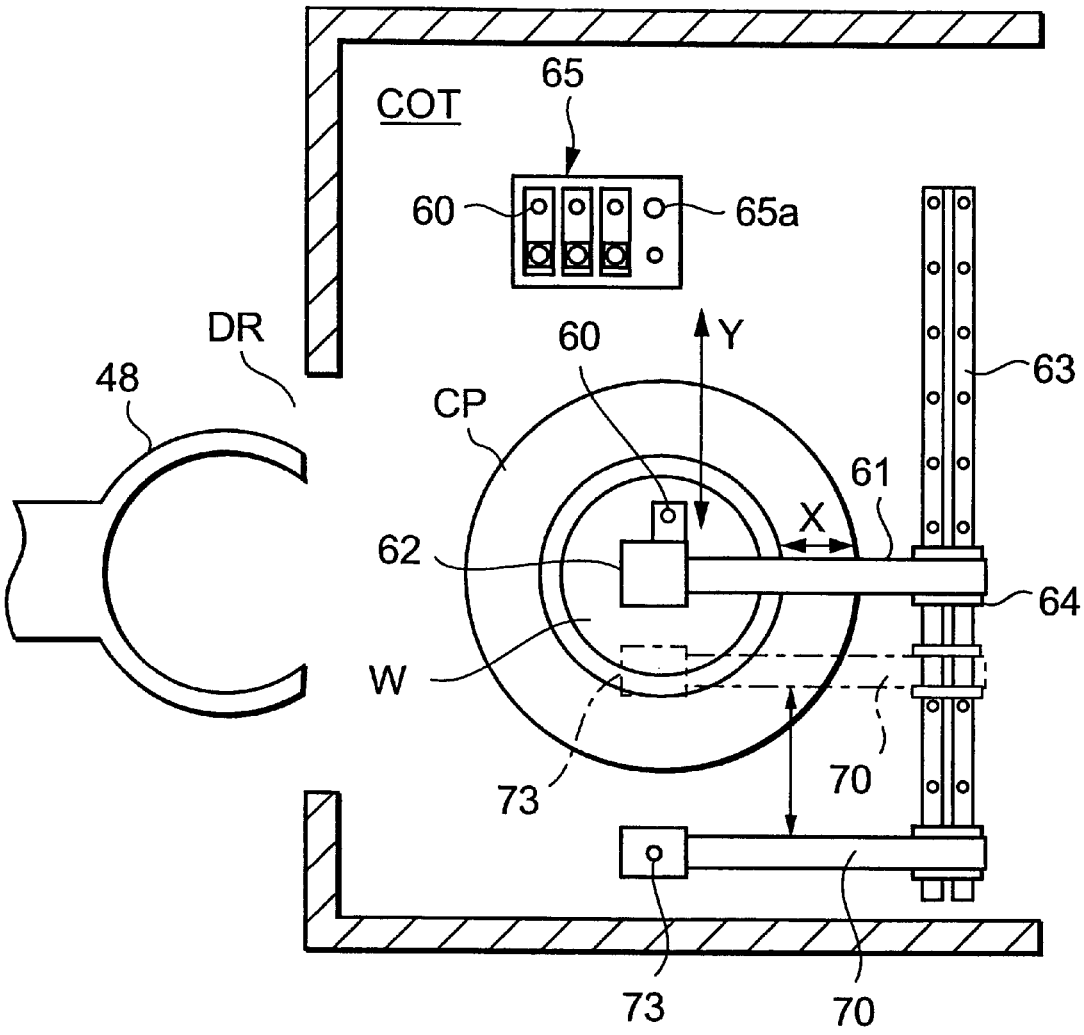
FIG. 5 is a schematic plane view of the resist coating unit according to the present embodiment.

A resist nozzle 60 for discharging a resist solution as a coating solution onto the front face of the wafer W is removably attached to the tip portion of a resist nozzle scan arm 61 with a nozzle holder 62 therebetween. The resist nozzle scan arm 61 is attached to the top end portion of a vertical support member 64 which can horizontally move on guide rails 63 laid on the unit bottom plate 50 in one direction (the Y-direction), so that it moves in the Y-direction integrally with the vertical support member 64 by a Y-direction drive mechanism not shown. FIG. 5 is a schematic plane view of the resist coating unit (COT) according to this embodiment.

The resist nozzle scan arm 61 can move also in the X-direction orthogonal to the Y-direction to selectively attach the resist nozzle 60 thereto at a resist nozzle standby section 65, and hence it moves also in the X-direction by an X-direction drive mechanism not shown.

Furthermore, a discharge port of the resist nozzle 60 is inserted into an aperture 65*a* of a solvent atmosphere chamber at the resist nozzle standby section 65 to be exposed to the atmosphere of the solvent therein, so that a resist solution at the tip of the resist nozzle 60 neither solidify nor deteriorate. Moreover, a plurality of resist nozzles 60, 60, . . . are provided and these resist nozzles 60 are properly used corresponding to the type or viscosity of resist solution.

On the guide rails 63, provided is not only the vertical support member 64 for supporting the resist nozzle scan arm 61 but also a vertical support member 73 for supporting a rinse nozzle scan arm 70 and movable in the Y-direction.

The Y-direction drive mechanism (not shown) translates or linearly moves the rinse nozzle scan arm 70 between a rinse nozzle standby position (a position shown by the solid line) which is set beside the cup CP and a rinse solution discharge position (a position shown by the dotted line) which is set directly above the peripheral portion of the wafer W placed on the spin chuck 51.

As shown in FIG. 4, the resist nozzle 60 is connected to a resist solution supply mechanism placed in the chamber under the resist coating unit (COT) by the medium of a resist supply pipe 66.

Next, a resist supply system of the resist coating unit (COT) according to this embodiment is explained.

Figure 6:
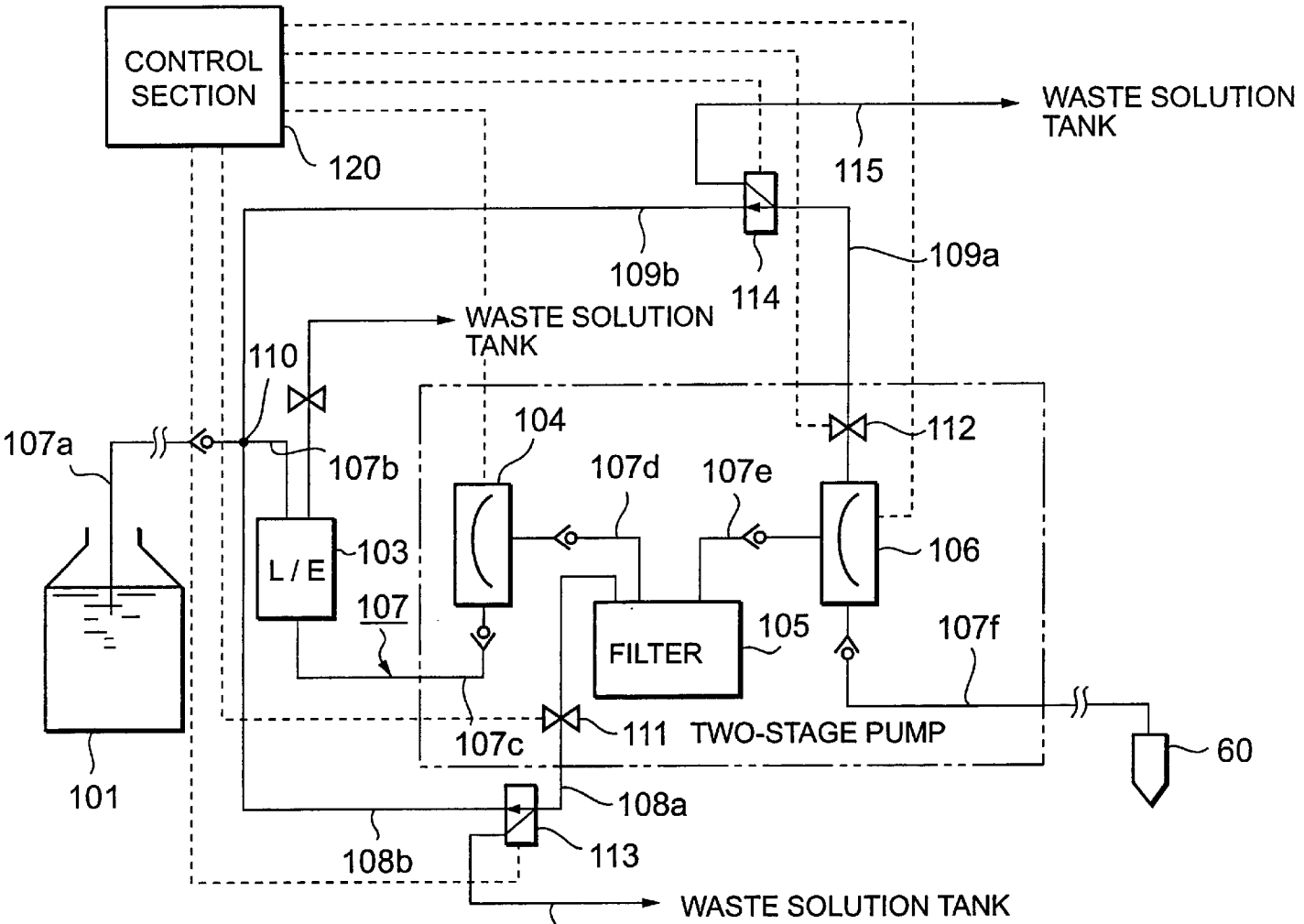
FIG. 6 is a schematic diagram of a resist supply system of the resist coating unit according to the present embodiment.

FIG. 6 is a schematic diagram of the resist supply system of the resist coating unit (COT) according to this embodiment. The solid lines in FIG. 6 show piping and the dotted lines show electrical wiring.

As shown in FIG. 6, in the resist supply system 100, a resist tank 101, a liquid end sensor 103, a supply pump 104, a filter 105, a discharge pump 106, and the resist nozzle 60 are stacked in this order that is a direction of movement of the resist solution, and these adjoining components are connected with each other by a supply pipe 107. To the filter 105 attached is a vent pipe 108 leading to waste solution tanks (not shown).

The discharge side of the supply pump 104 and the suck side of the discharge pump 106 are connected to each other with the filter 105 therebetween, so that the resist solution discharged from the supply pump 104 first passes through the inside of the filter 105 and then sent into the discharge pump 106.

In the filter 105, a filter module (not shown) for filtering the resist solution is provided between the junction thereof with a supply pipe 107*d* and the junction thereof with a supply pipe 107*e*, so that the resist solution which has been sent from the supply pump 104 passes through the filter module to be filtered and is then sent to the discharge pump 106 side.

A purge pipe 109 is attached to the discharge pump 106 on the downstream side in a direction of movement of the processing solution. This purge pipe 109 is connected to a cross branch pipe 110 which is attached to a supply pipe 107*b* between the resist tank 101 and the liquid end sensor 103 so as to allow the resist solution which has passed through the purge pipe 109 to join the supply pipe 107*b*.

On end of the vent pipe 108 is also connected to the cross branch pipe 110 so as to allow the resist solution which has passed through the vent pipe 108 to join the supply pipe 107*b*.

At a midpoint in the vent pipe 108, a first three-way valve, that is, a vent-side three-way valve 113 is provided.

The input side of the first three-way valve 113 is connected to the filter 105, and one of two output sides of the first three-way valve 113 is connected with a vent pipe 108*b* leading to the cross branch pipe 110 leading to the supply pipe 107*b*. The other output side of the first three-way valve 113 is connected with a waste solution pipe 116 leading to a waste solution tank (not shown). Accordingly, it is possible to allow a vent pipe 108*a* and the vent pipe 108*b* to communicate with each other and allow the vent pipe 108*a* and the waste solution pipe 116 to communicate with each other by switching the first three-way valve 113. At a midpoint in the vent pipe 108*a* which links the filter 105 and the first three-way valve 113 is provided a vent valve 111 with which the inside of the vent pipe 108 is opened and closed.

Similarly, at a midpoint in the purge pipe 109, a second three-way valve, that is, a purge-side three-way valve 114 is provided.

The input side of the second three-way valve 114 is connected to the discharge side of the discharge pump 106, and one of two output sides of the second three-way valve 114 is connected with a purge pipe 109*b*. This purge pipe 109*b* is led to the supply pipe 107*b* through the cross branch pipe 110. The other output side of the second three-way valve 114 is connected with a waste solution pipe 115 which is led to a waste solution tank (not shown). Accordingly, it is possible to allow a purge pipe 109*a* and the purge pipe 109*b* to communicate with each other and allow the purge pipe 109*a* and the waste solution pipe 115 to communicate with each other by switching the second three-way valve 114. At a midpoint in the purge pipe 109*a* which links the discharge pump 106 and the second three-way valve 114 is provided a purge valve 112 with which the inside of the purge pipe 109 is opened and closed.

As shown in FIG. 6, all of the supply pump 104, the discharge pump 106, the vent valve 111, the first three-way valve 113, the purge valve 112, and the second three-way valve 114 are electrically connected to a control section 120 and collectively controlled by the control section 120.

Next, an operation of removing bubbles from the inside of the piping by operating the resist solution supply apparatus according to this embodiment will be explained.

Figure 7:
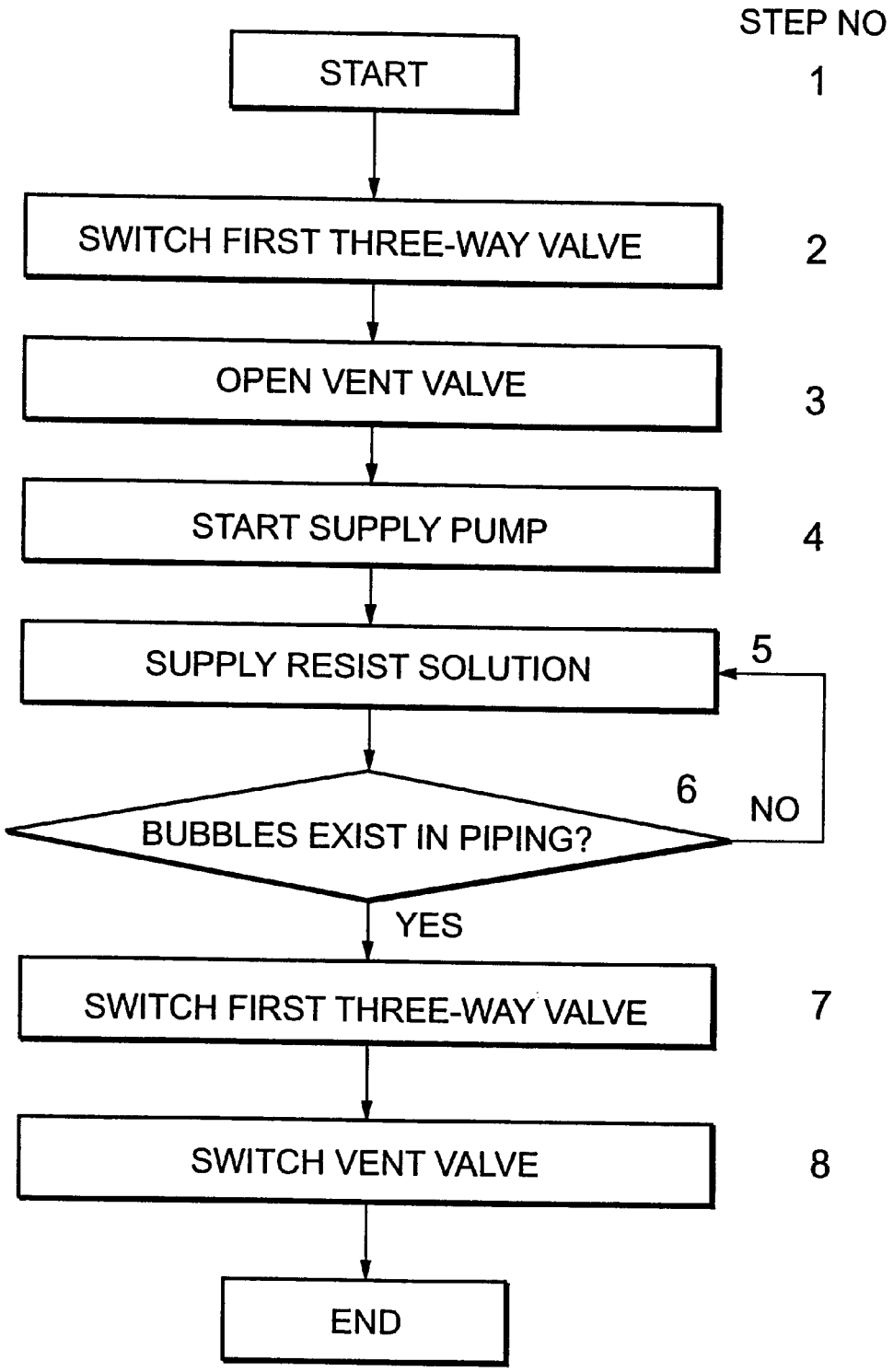
FIG. 7 is a flowchart of a bubble-removal operation in the case where the resist solution supply apparatus according to the present embodiment is temporarily stopped and then restarted.

FIG. 7 is a flowchart showing procedures of the bubble-removal operation in the case where the resist solution supply apparatus is temporarily stopped and then restarted, such as the case where a resist solution is newly installed into the resist solution supply apparatus and the case where the filter module in the filter 105 is exchanged for another.

First, necessary preparations such as filling a new resist solution into the resist tank 101 and exchange of the filter module are done, and then the resist solution supply apparatus is started (step 1).

The first three-way valve 113 is switched simultaneously with the start of the resist solution supply apparatus, thereby allowing the vent pipe 108*a* and the waste solution pipe 116 to communicate with each other (step 2).

Next, the vent valve 111 is opened to bring the vent pipe 108*a* to a state where the resist solution can flow therein (step 3).

The supply pump 104 is started in this state (step 4).

By the start of the supply pump 104, the resist solution in the resist tank 101 is drawn up to flow into the filter 105 via the supply pipes 107*a* to 107*d* (step 5).

At this time, since the discharge pump 106 is not operated, the resist solution which has flowed into the filter 105 flows into the vent pipe 108*a*. Accompanying with the inflow of the resist solution, air in the supply pipe 107, the filter 105, and the vent pipe 108*a* is pushed out. Therefore, into the waste solution pipe 116, air flows first, then a resist solution containing a large amount of bubbles flows, the amount of the bubbles gradually decreasing, and finally a resist solution without bubbles flows out. This state is monitored by personnel or by the use of a bubble sensor (not shown) for monitoring the presence or absence of bubbles in the piping (step 6).

At the time when the resist solution containing bubbles does not flow into the waste solution pipe 116 side, the first three-way valve 113 is switched to allow the vent pipe 108*a* side and the vent pipe 108*b* side to communicate with each other (step 7).

By the switching of the first three-way valve 113, the resist solution flows from the vent pipe 108*a* side to the vent pipe 108*b* side. This resist solution flows into the supply pipe 107*b* again at the cross branch pipe 110 and joins the resist solution which has been drawn up from the resist tank 101 and flows toward the filter 105. At the beginning, air remains also in the vent pipe 108*b*, and thus bubbles easily form. Therefore, the monitoring of bubbles in the piping is continued for an interval during which the resist solution circulated from the supply pipe 107 through the filter 105 and the vent pipe 108 returns into the supply pipe. When bubbles are viewed, the first three-way valve 113 is properly switched and bubbles in the piping are removed. The state has changed to that bubbles are not viewed, the vent valve 111 is closed and the bubble-removal operation is finished (step 8).

Next, a bubble-removal operation when formation of bubbles in the piping is recognized during the normal operation of discharging the resist solution onto the wafer W will be explained.

Figure 8:
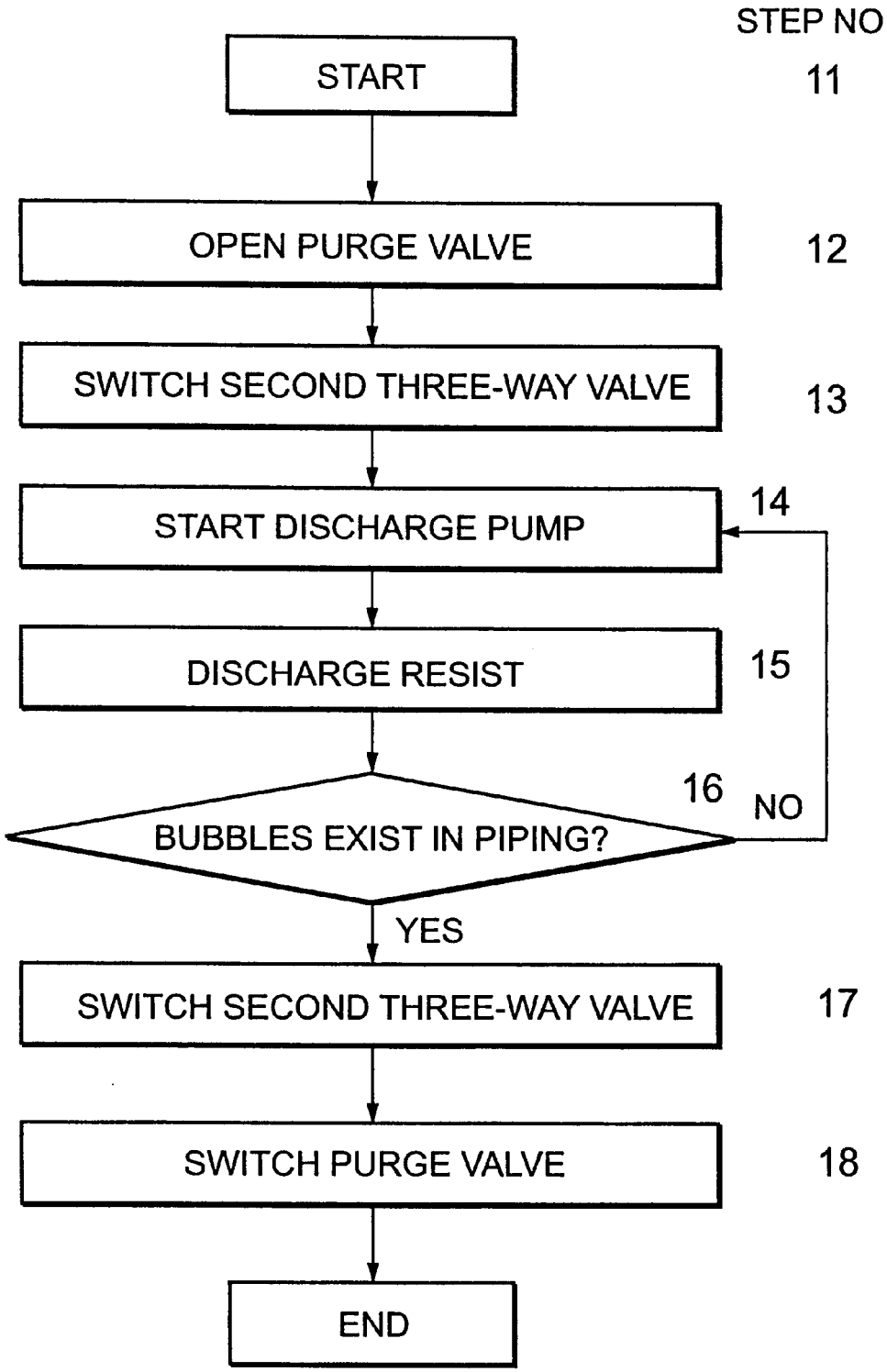
FIG. 8 is a flowchart of a bubble-removal operation performed during the normal operation of the resist solution supply apparatus according to the present embodiment.

FIG. 8 is a flowchart of the operation of removing bubbles in the piping during the normal operation of the resist solution supply apparatus.

When the formation of bubbles is recognized in the piping during the normal operation of the apparatus, the purge valve 112 is first opened, so that the resist solution does not flow to the resist nozzle 60 side (steps 11 and 12). By this operation, the resist solution comes to flow from the discharge pump 106 to the purge pipe 109*a* side. The second three-way valve 114 is switched simultaneously with the operation of opening the purge valve 112, thereby allowing the purge pipe 109*a* and the waste solution pipe 115 to communicate with each other (step 13).

The discharge pump 106 is started in this state, thereby allowing the resist solution containing bubbles to flow out from the purge pipe 109*a* side to the waste solution pipe 115 side (step 14).

The state of the resist solution flowing out to the waste solution pipe 115 side is monitored by personnel or the bubble sensor (not shown) and the timing of the resist solution containing bubbles changing to the resist solution without bubbles is detected (step 16).

When the resist solution without bubbles starts to flow out, the second three-way valve 114 is switched again to allow the purge pipe 109*a* side and the purge pipe 109*b* side to communicate with each other (step 17).

After the completion of the operation of removing bubbles in the piping, the purge valve 112 is closed (step 18) so as to allow the resist solution to flow from the discharge pump 106 to the resist nozzle 60 side.

As has been described in detail, in the resist solution supply apparatus of this embodiment, since the first three-way valve 113 is provided at the vent pipe 108 and the waste solution pipe 116 or the supply pipe 107 is selectively connected to the vent pipe 108 with the first three-way valve 113 therebetween, only the resist solution containing bubbles can be disposed of by properly switching the first three-way valve 113. Consequently, almost all wasteful disposal of the resist solution can be eliminated.

Further, in the resist solution supply apparatus of this embodiment, since the second three-way valve 114 is provided at the purge pipe 109 and the waste solution pipe 115 or the supply pipe 107 is selectively connected to the purge pipe 109 with the second three-way valve 114 therebetween, the bubble-removal can be performed even from the purge pipe 109 by properly switching the three-way valve 114. Consequently, recirculation of the resist solution containing bubbles can be prevented, thereby accurately controlling the discharge amount of the resist solution.

It should be noted that the present invention is not limited to description in the above embodiment.

More specifically, though both the vent pipe and the purge pipe communicate with the supply pipe, and three-way valves are provided at both of the vent pipe and the purge pipe, whereby the bubble-removal operation can be performed from any of the vent pipe and the purge pipe for the bubbles which have formed in the piping in the above embodiment, it is also suitable that a three-way valve is provided at either the vent pipe or the purge pipe and the bubble-removal operation is performed by switching the three-way valve.

Furthermore, whether or not the resist solution containing bubbles remain in the piping is visually checked by personnel in the above embodiment, it is also suitable that the monitoring is performed using a bubble sensor for detecting whether or not bubbles are contained in the resist solution passing through the piping, and the three-way valves are switched based on the detected results of the bubble sensor.

In this case, the bubble sensor is provided inside the vent pipe and when the existence of bubbles in the vent pipe is detected by the bubble sensor, the vent-side three-way valve is switched to dispose of the resist solution containing bubbles to the waste solution pipe side, and at the time when bubbles are not detected any more, the vent-side three-way valve is switched to allow the resist solution to join the supply pipe, thereby performing control to remove bubbles in the vent pipe.

On the other hand, in the case where bubbles are removed from the purge pipe side, a bubble sensor is provided at a midpoint in the purge pipe and when the existence of bubbles in the purge pipe is detected by the bubble sensor, the purge-side three-way valve is switched to dispose of the resist solution containing bubbles to the waste solution pipe side, and at the time when bubbles are not detected any more, the purge-side three-way valve is switched to allow the resist solution to join the supply pipe, thereby performing control to remove bubbles in the purge pipe.

Moreover, it is suitable that a bubble sensor is provided also at a midpoint in the supply pipe and when the occurrence of bubbles in the supply pipe is detected, the purge valve is closed, and after the resist solution containing bubbles is moved to the purge pipe side, the purge-side three-way valve is properly switched based on the detected results of the bubble sensor in the purge pipe, thereby disposing of the resist solution containing bubbles to the waste solution pipe as described above.

Furthermore, as a method of removing the resist solution containing bubbles in the piping, there is the following method. When a resist solution is newly installed, the resist solution, which is supplied right after the start of supply of the resist solution has a high possibility of containing bubbles. The amount of the resist solution is obtained in advance by an experiment or the like. A predetermined amount of resist solution is set to be disposed of after the installation, and a controller is programmed in advance so that a predetermined amount of the resist solution which is first discharged is unconditionally disposed of.

Though the description is presented taking an example of a resist coating apparatus for a wafer W in the above embodiment, but it is needless to say that the present invention can be applied to another apparatuses, for example, a resist coating apparatus or a processing apparatus for a glass substrate for a liquid crystal device.

(Second Embodiment)

Figure 9:
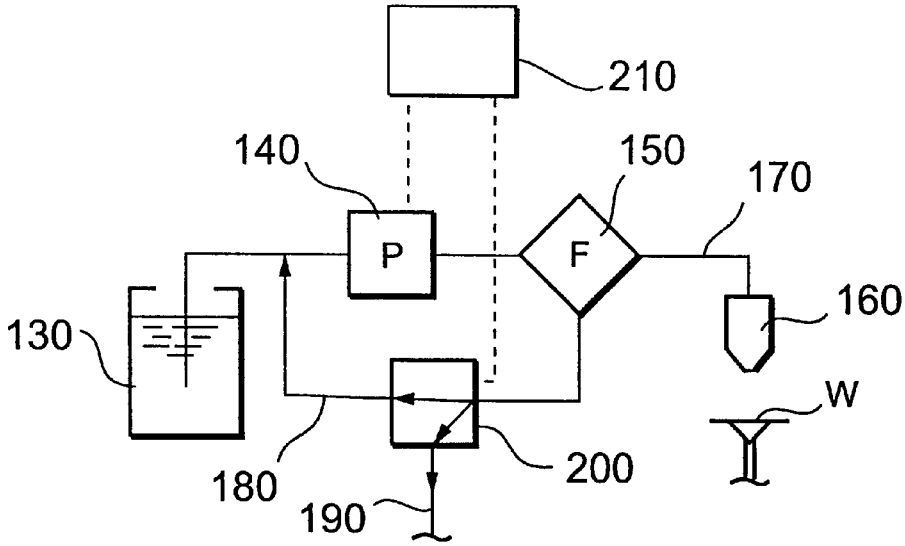
FIG. 9 is a diagram schematically showing the configuration of a resist solution supply apparatus according to a second embodiment of the present invention.

Next, the second embodiment of the present invention is explained hereinafter. Incidentally, as for portions in this embodiment which overlap with those of the first embodiment, the description thereof is omitted. FIG. 9 is a diagram schematically showing the configuration of a processing solution supply apparatus according to this embodiment. As shown in FIG. 9, in this processing solution supply apparatus, a resist tank 130, a pump 140, a filter 150, and a discharge nozzle 160 are stacked in this order. These are linked with each other by a supply pipe 170, so that a resist solution in the resist tank 130 is sent to the discharge nozzle 160 via the pump 140 and the filter 150 to be discharged from the discharge nozzle 160 onto the wafer W. Further, in this processing solution supply apparatus, the filter 150 and the supply pipe upstream from the pump 140 relative to the direction of movement of the resist are linked with each other by a by-pass pipe 180, and a waste solution pipe 190 branches off at a midpoint in the by-pass pipe. A three-way valve 200 is provided at a junction between the waste solution pipe 190 and the by-pass pipe 180.

The pump 140 and the three-way valve 200 are electrically connected to a control section 210, and the pump 140 and the three-way valve 200 are collectively controlled by the control section 210. When the processing solution supply apparatus is operated, the pump 140 and the three-way valve 200 are started at appropriate timing, thereby removing bubbles from the inside of the pipe 170.

For instance, at the time when the apparatus is started or when air enters the pipe 170 due to the exchange of the resist solution in the resist tank 130, the three-way valve 200 is first switched to the waste solution pipe 190 side and then pump 210 is started to start the supply of the resist. The resist flows from the resist tank 130 into the pipe, the pump 140, and the filter 150, but bubbles constitute most of the resist at the beginning. While bubbles are contained in the resist in large quantity, the resist is allowed to flow from the three-way valve 200 to the waste solution pipe 190 side to be disposed of. After a while, when bubbles are not contained in the resist, the three-way valve 300 is switched, so that the resist flows from the filter 150 into the pipe on the upstream side of the pump 140. As described above, the three-way valve 200 is switched when required, thereby efficiently removing the bubbles stayed in the filter 150.

Figure 10:
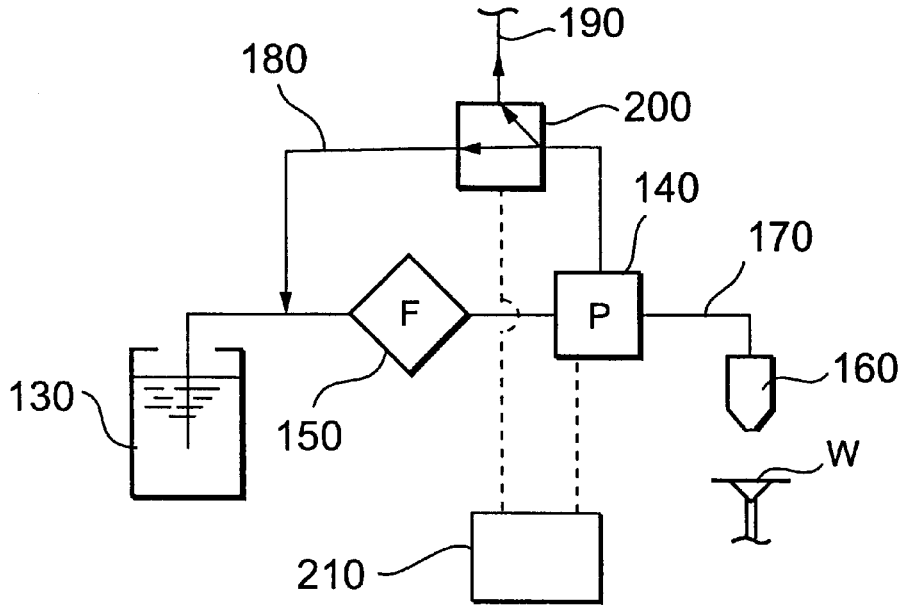
FIG. 10 is a schematic diagram of the resist solution supply apparatus according to a modification of the second embodiment of the present invention.

As a modification of this embodiment, it is suitable that the filter 150 is placed between the pump 140 and the resist tank 130, and the pump 140 and the supply pipe on the upstream side of the filter 150 are linked together by the by-pass pipe 180, and the waste solution pipe 190 is linked to the by-pass pipe 180 with the three-way valve 200 therebetween as shown in FIG. 10.

Figure 11:
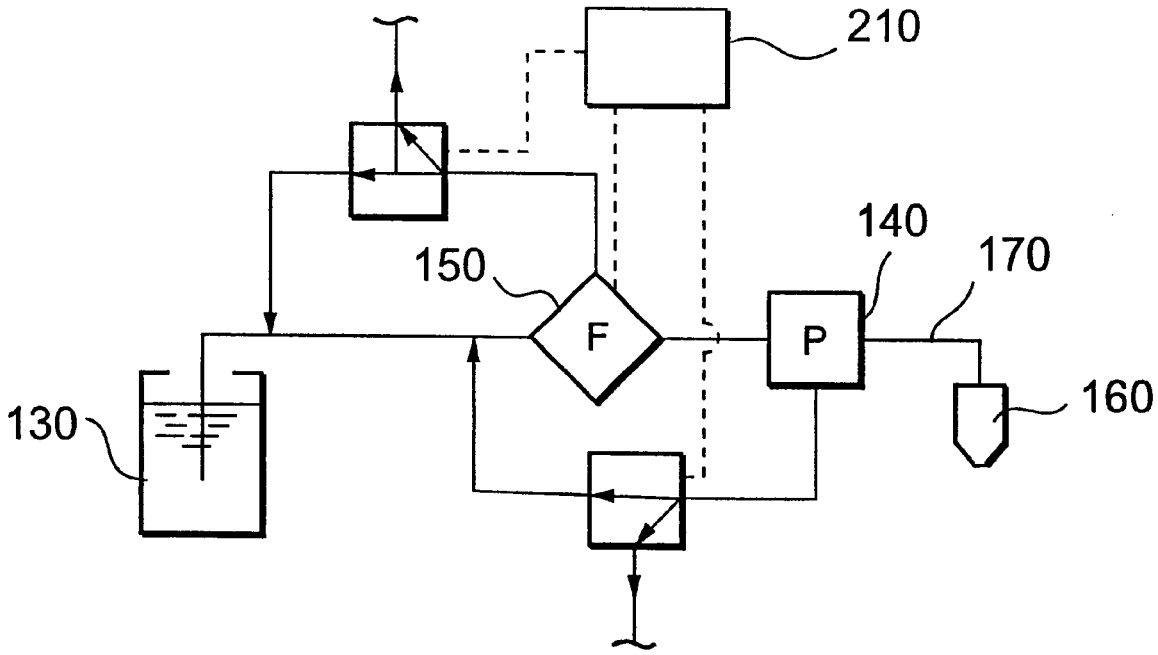
FIG. 11 is a schematic diagram of the resist solution supply apparatus according to a modification of the second embodiment of the present invention.

Furthermore, as shown in FIG. 11, it is also suitable that respective by-pass pipes are linked to both the filter 150 and the pump 140 and linked to the supply pipe on the upstream side from the filter 150 and the pump 140, and waste solution pipes are linked to the respective by-pass pipes with three-way valves therebetween. Through such a configuration, the bubbles stayed in both the filter 150 and the pump 140 can be efficiently removed.

(Third Embodiment)

Figure 12:
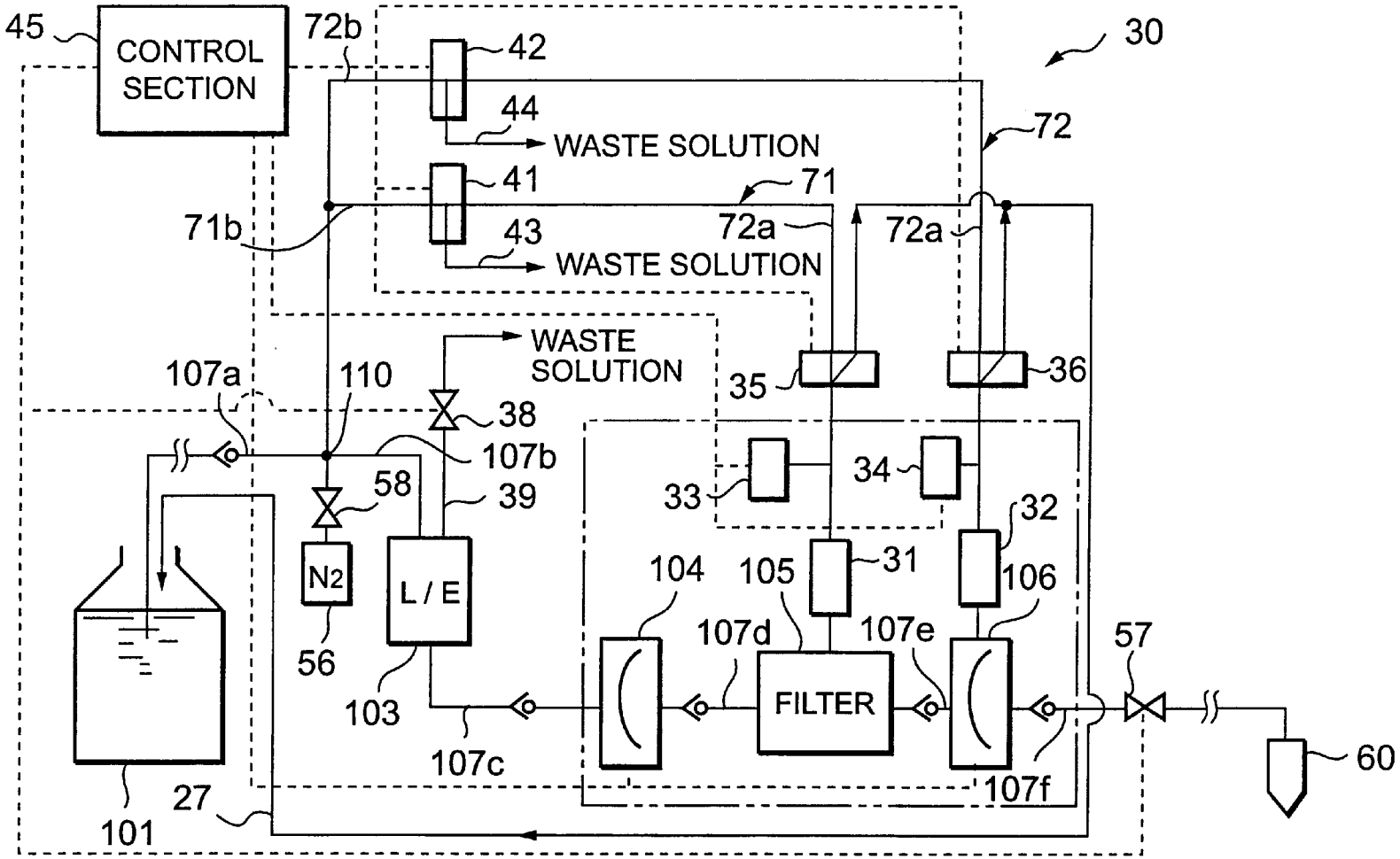
FIG. 12 is a schematic diagram of a resist solution supply apparatus according to a third embodiment of the present invention.

FIG. 12 is a schematic diagram showing a processing solution supply apparatus according to the third embodiment of the present invention. Incidentally, in a processing solution supply apparatus 30, the same numerals are given to the same components as those in the first and second embodiments.

A return pipe 27 is provided by respectively branching out from a vent pipe 71 provided between a filter 105 and a branch pipe 110 and from a purge pipe 72 provided between a discharge pump 106 and the branch pipe 110 and joining together, and the downstream portion of the return pipe 27 leads to a resist tank 101. The vent pipe 71 is provided with a vent-side three-way valve 35 for allowing the filter 105 to communicate with the branch pipe 110 or the return pipe 27, and the purge pipe 72 is also provided with a purge-side three-way valve 36 for allowing the discharge pump 106 to communicate with the branch pipe 110 or the return pipe 27. It should be noted that though the return pipe 27 is formed by branching out from the vent-side three-way valve 35 and the purge-side three-way valve 36 and joining together into one pipe, it may naturally be formed in two pipes without joining together.

Between the vent-side three-way valve 35 and the branch pipe 110 is provided a vent-side switching valve 41 for allowing the vent-side three-way valve 35 and the branch pipe 110 to communicate together, allowing the vent-side three-way valve 35 and a waste solution pipe 43 to communicated together, or allowing the branch pipe 110 and the waste solution pipe 43 to communicate together. Similarly on the purge side, between the purge-side three-way valve 36 and the branch pipe 110 is provided a purge-side switching valve 42 for allowing the purge-side three-way valve 36 and the branch pipe 110 to communicate together, allowing the purge-side three-way valve 36 and a waste solution pipe 44 to communicated together, or allowing the branch pipe 110 and the waste solution pipe 44 to communicate together. Further, between the filter 105 and the vent-side three-way valve 35, a vent-side sensor 33 is provided as a means for detecting the existence of bubbles passing from the supply pipe 107 through a vent pipe upstream portion 71*a*. Similarly on the purge side, a purge-side sensor 34 is provided as a means for detecting the existence of bubbles passing from the supply pipe 107 through a purge pipe upstream portion 72*a*.

On the upstream side of the vent-side sensor 33 and on the upstream side of the purge-side sensor 34, a vent-side vibrator 31 and a purge-side vibrator 32 for gently vibrating the pipes to gather a number of minute bubbles together are provided respectively in order to efficiently detect bubbles by the respective sensors 33 and 34.

As for positional relations between these components, the vent-side three-way valve 35 and the purge-side three-way valve 36 are provided vertically above the filter 105 and the discharge pump 106 respectively. This arrangement is effective at gathering bubbles at the three-way valves 35 and 36 by virtue of buoyant force of bubbles in the supply pipe 107. Moreover, the vent-side vibrator 31 and the purge-side vibrator 32 cause minute bubbles to gather together, whereby bubbles increase in size to increase buoyant force thereof, which is more effective in the aforesaid gathering of bubbles.

A supply pipe 107*f* is provided with a supply pipe valve 57 for stopping the supply of the resist flowing to a resist nozzle 60.

A nitrogen gas cylinder 56 as a processing solution removing means for removing the processing solution in the branch pipe 110, the supply pipe 107, the vent pipe 71, and the purge pipe 72 is further provided at the branch pipe 110 with a valve 58 therebetween.

Furthermore, provided is a control section 45 for collectively controlling each of the three-way valves 35 and 36, each of the switching valves 41 and 42, each of the sensors 33 and 34, each of the vibrators 31 and 32, and the opening and closing of a drain valve 38 which is provided at the waste solution pipe of a liquid end sensor 103 and the opening and closing of the supply valve 57.

Figure 13:
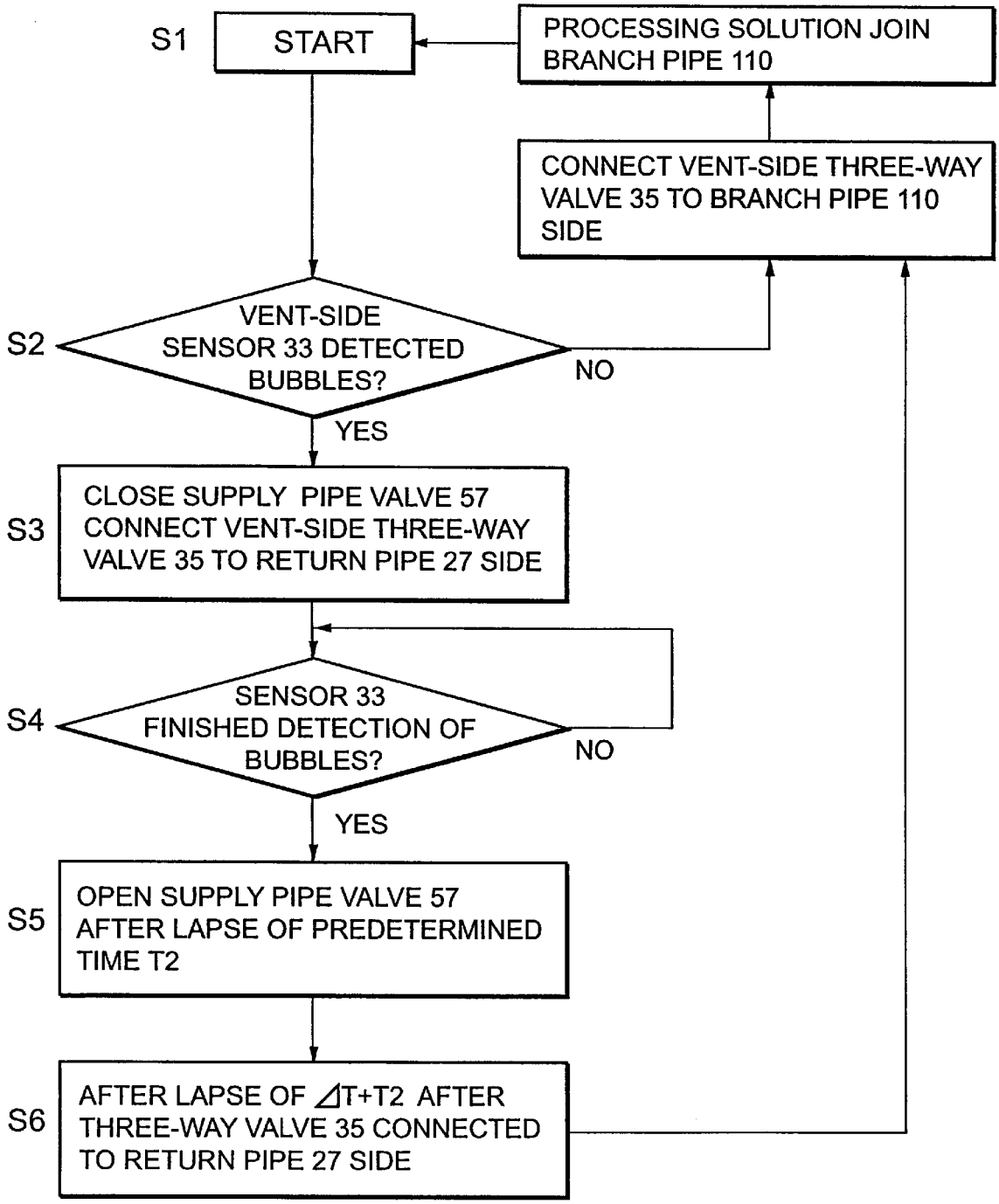
FIG. 13 is a flowchart of a bubble-removal operation performed during the normal operation of the resist solution supply apparatus according to the third embodiment of the present invention.
Figure 14:
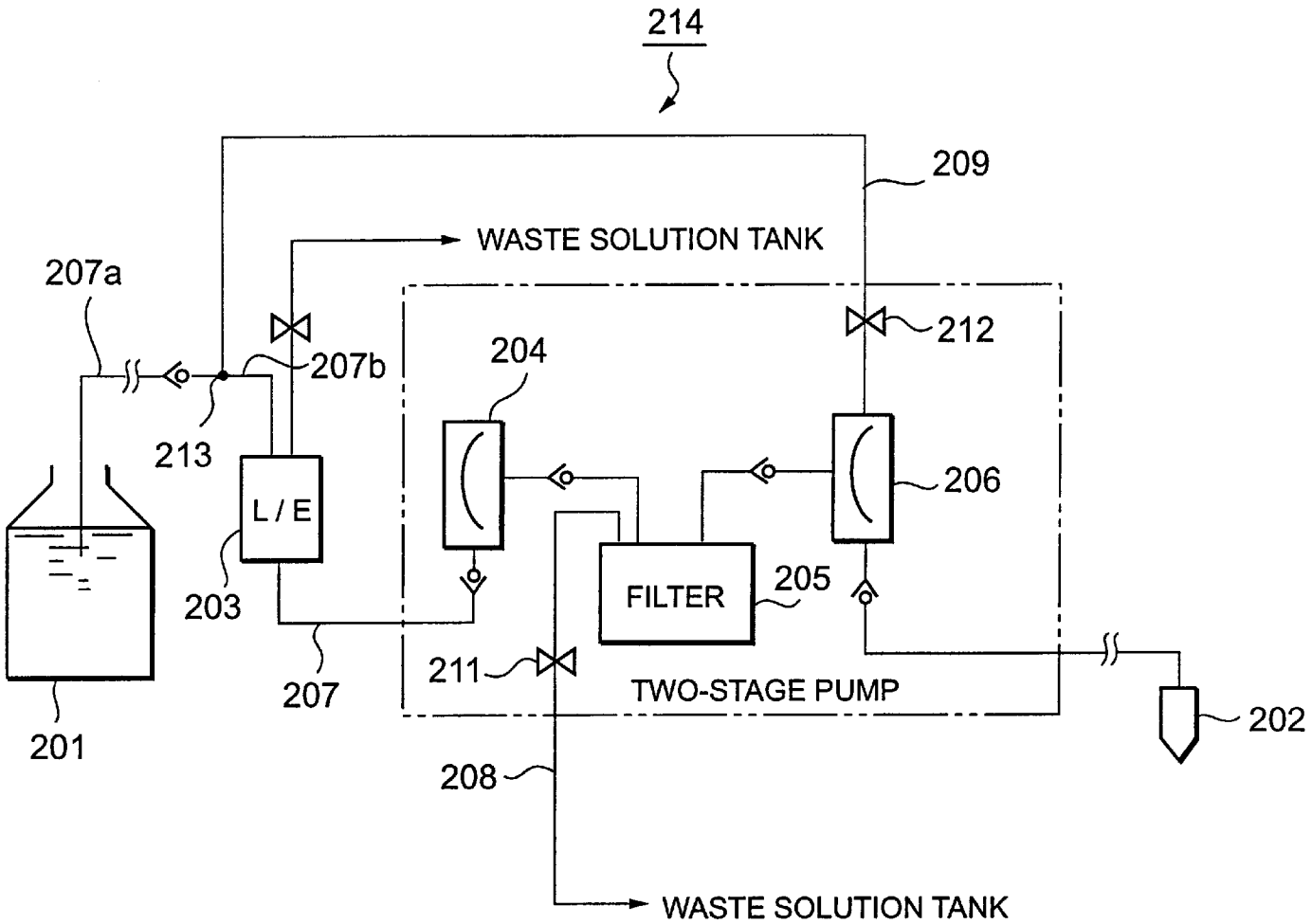
FIG. 14 is a schematic diagram of a resist supply system of a conventional resist coating unit.

Next, a method of removing bubbles in the pipe 107 when the processing solution supply apparatus 30 in operation is temporarily stopped and thereafter restarted (during the normal operation) will be explained using a flowchart shown in FIG. 13.

During the operation of the processing solution supply apparatus 30, the vent-side switching valve 41 is always in the state of allowing the vent-side three-way valve 35 and the branch pipe 110 to communicate together by a command from the control section 45. Since the length of the pipe from the vent-side three-way valve 35 to the vent-side sensor 33 and the amount of the processing solution flowing in the vent pipe 71 per unit of time are at set values, a time T1, a period of time during which the bubbles detected by the vent-side sensor 33 reach the vent-side three-way valve 35, is set in advance. Incidentally, the vent-side vibrator 31 is gently vibrated in order to gather together as much as possible bubbles existing separately in the pipe.

When first bubbles which have gathered to some extent are detected by the vent-side sensor 33 (S2), the supply pipe valve 57 is closed by a command of the control section 45, and the vent-side three-way valve 35 is connected to the return pipe 27 side after a lapse of the aforesaid predetermined time T1 (S3). Then, the control section 45 stores a time ΔT that is a period of time that elapses after the vent-side sensor 33 detects the first bubbles until it detects the last many bubbles gathered to some extent. A certain period of time after the vent-side sensor 33 detects the last bubbles (S4), for example, a time T2, is set in advance, and the supply pipe valve 57 is opened after a lapse of the time T2 (S5). Then, after a lapse of the time ΔT+T2 after the vent-side three-way valve 35 is connected to the return pipe 27, the vent-side three-way valve 35 is connected to the branch pipe 110 side (S6). Thereby, the processing solution containing bubbles is not disposed of and all of it is returned to the resist tank 101 through the return pipe 27, while the processing solution without bubbles is all returned from the vent pipe 71 through the branch pipe 110 to the supply pipe 107. Thereby, wasteful disposal of the processing solution can be prevented. Incidentally, such a series of operations is fully automatically controlled by the control section 45.

In the above bubble-removal method, the same operation is performed on the vent pipe 71 side and on the purge pipe 72 side, therefore the description about the purge pipe 72 side is omitted.

Next, the case where after the processing solution supply apparatus 30 in operation is stopped (after the coating processing for the wafer is completed and the processing solution supply apparatus 30 is stopped), the inside of the piping is cleaned with a thinner will be explained. It should be noted that since the same operation is performed on the vent pipe 71 side and on the purge pipe 72 side, only the operation on the vent pipe 71 side is explained.

First, the connection linking the resist tank 101 and the supply pipe 107 is blocked and the drain valve 38 of the liquid end sensor 103 is opened. Then, the vent-side switching valve 41 (the purge-side switching valve 42) allows the branch pipe 110 side and the waste solution pipe 43 (44) to communicate together, and thereafter the valve 58 of the nitrogen cylinder 56 is opened to dispose of the processing solution remaining in the supply pipes 107*a* and 107*b*, the branch pipe 110, and the vent pipe 71*b* (the purge pipe 72*b*) from each of the waste solution pipes 39 and 43 (44) by the gas blast.

Next, the drain valve 38 of the liquid end sensor 103 is closed, and the vent-side switching valve 41 (the purge-side switching valve 42) allows the vent-side three-way valve 35 (the purge-side three-way valve 36) and the waste solution pipe 43 to communicate together. Moreover, the vent-side three-way valve 35 (the purge-side three-way valve 36) is switched to the branch pipe 110 side, and the supply pump 104 and the discharge pump 106 are started. At this time, nitrogen gas is continued to be blasted. Thereby, the processing solution remaining in the supply pipe 107 and the vent pipe 71*a* (the purge pipe 72*a*) is disposed of from the waste solution pipe 43 (44).

Thereafter, a tank (not shown) storing a thinner is connected to the supply pipe 107, the drain valve 38 of the liquid end sensor 103 is closed, and the vent-side switching valve 41 (the purge-side switching valve 42) allows the branch pipe 110 and the waste solution pipe 43 (44) to communicate together. The vent-side three-way valve 35 (the purge-side three-way valve 36) is switched to the return pipe 27 side, and while the thinner is allowed to flow into the supply pipe 107, the branch pipe 110, and the vent pipe 71*b* (the purge pipe 72*b*) by the operation of each of the pump 104 and 106 and the gas blast from the nitrogen gas cylinder 56, the thinner is disposed of from the waste solution pipe 43 (44) and the pipes are dried.

Next, the vent-side switching valve 41 allows the vent-side three-way valve 35 and the waste solution pipe 43 to communicate together, and the vent-side three-way valve 35 is connected to the branch pipe 110 side. While a thinner is allowed to flow into the supply pipe 107 and the vent pipe 71*a*, the thinner is disposed of from the waste solution pipe 43 (44) and the pipes are dried.

Finally, the vent-side three-way valve 35 (the purge-side three-way valve 36) is connected to the return pipe 27 side, and while a thinner is allowed to flow into the supply pipe 107 and the return pipe 27, the thinner is returned to the thinner tank and the pipes are dried. Such a series of operations is fully automatically controlled by the control section 45.

Thereby, the entire piping can be cleaned with the thinner and dried with nitrogen gas, whereby the used processing solution can be completely removed. Accordingly, in the case of installation of a new resist as will be described later, there is no danger that the used processing solution and a new processing solution mix.

Next, the case where after the inside of each pipe is cleaned with a thinner, a new resist (a processing solution) is filled in the piping of the processing solution supply apparatus 30 will be explained. Also in this case, the processing solution supply apparatus 30 is not operated (not performing the coating processing for the wafer) as in the case of cleaning with a thinner. It should be noted that since the same operation is performed on the vent pipe 71 side and on the purge pipe 72 side, only the operation on the vent pipe 71 side is explained.

First, a new resist tank is connected to the supply pipe 107 and the drain valve 38 of the liquid end sensor 103 is closed. Then, the supply pipe valve 57 is opened and the processing solution is poured into the supply pipe 107 by the operation of the pumps 104 and 106. Then, the vent-side three-way valve 35 (the purge-side three-way valve 36), the vent-side switching valve 41 (the purge-side switching valve 42) are properly switched to fill the processing solution into each of the vent pipe 71, the purge pipe 72, and the return pipe 27.

The amount of bubbles in each pipe after the new resist is filled as above is larger than the amount of bubbles during the normal operation, and thus bubble-removal is performed by a manual operation.

When the bubble-removal is performed, the supply pipe valve 57 is closed while each of the pumps 104 and 106 is being operated. The vent-side switching valve 41 (the purge-side switching valve 42) allows the vent-side three-way valve 35 (the purge-side three-way valve 36) and the discharge pipe 110 to communicate together. While the processing solution is circulated from the supply pipes 107*b* to 107*e* through the vent pipe 71 (the purge pipe 72) and the branch pipe 110 returning to the supply pipes 107*b* to 107*e*, the existence of bubbles in the processing solution is checked by the vent-side sensor 33 (the purge-side sensor 34). At this time, the vent-side vibrator 31 (the purge-side vibrator 32) is optionally used. When bubbles are detected, the vent-side switching valve 41 (the purge-side switching valve 42) is switched to the waste solution pipe 43 (44) to dispose of the processing solution containing bubbles. It is unnecessary to perform the bubble-removal for the return pipe 27, because bubbles are contained in the processing solution even after the start of the apparatus 30. That is because the return pipe 27 is a pipe for returning only the processing solution containing bubbles to the resist tank 101 as described above.

Thereafter, the supply pipe valve 57 is opened and the processing solution supply apparatus 30 is started to thereby start the coating processing for the wafer. Then, the bubble-removal operation is performed in the same sequence as during the aforesaid normal operation.

In the above third embodiment, the bubble-removal may be all performed by a manual operation during the normal operation and when the inside of the piping is cleaned with a thinner.

According to the present invention, the branch pipe is provided at the pipe between the container and the pump, and additionally, the three-way valve is provided at the by-pass pipe for linking the branch pipe and the pump, and the three-way valve is switched to thereby perform the removal of bubble in the piping, resulting in no wasteful disposal of the processing solution.

Further, according to the present invention, a circulating path from the supply pipe to the filter, from the filter through the vent pipe, returning to the supply pipe is formed and the vent-side three-way valve is provided at the vent pipe, and the vent-side three-way valve is switched to thereby perform the removal of bubbles in the piping, resulting in no disposal of the processing solution without bubbles, thereby preventing wasteful disposal of the processing solution.

Furthermore, according to the present invention, a circulating path from the supply pipe to the discharge pump, from the discharge pump through the purge pipe, returning to the supply pipe is formed and the purge-side three-way valve is provided at the purge pipe, and the purge-side three-way valve is switched to thereby perform the removal of bubble in the piping, resulting in no disposal of the processing solution without bubbles, thereby preventing wasteful disposal of the processing solution.

Moreover, according to the present invention, a circulating path from the supply pipe to the filter, from the filter through the vent pipe, returning to the supply pipe is formed and the vent-side three-way valve is provided at the vent pipe, and additionally, a circulating path from the supply pipe to the discharge pump, from the discharge pump through the purge pipe, returning to the supply pipe is formed and the purge-side three-way valve is provided at the purge pipe, and the vent-side three-way valve and the purge-side three-way valve are switched to thereby perform the removal of bubble in the piping, whereby the bubble-removal operation can be performed from any of the vent side and the purge side. Consequently, the bubble-removal operation can be performed when required, not only at the time of installation of the processing solution and exchange of the filters but also during the normal operation.

Further, according to the present invention, during the normal operation, the processing solution containing bubbles in the supply pipe is not disposed of and all returned to the processing solution supply source by the return pipe, and on the other hand, the processing solution without bubbles is all returned from the purge pipe through the branch pipe to the supply pipe. Thereby, wasteful disposal of the processing solution can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A processing solution supply apparatus, comprising:

a discharge unit configured to discharge a processing solution onto a substrate;

a processing solution supply source configured to store the processing solution;

a supply pipe configured to link said discharge unit and said processing solution supply source;

a pump provided at said supply pipe;

a control unit configured to control operation of said pump;

a branch pipe provided at a pipe between said processing solution supply source and said pump;

a by-pass pipe configured to link said branch pipe and said pump;

a three-way valve provided at said by-pass pipe and configured to allow said pump to communicate with said branch pipe or a waste solution pipe; and a switch unit configured to switch said three-way valve.

2. A processing solution supply apparatus comprising:

a discharge unit configured to discharge a processing solution onto a substrate;

a processing solution supply source configured to store the processing solution;

a supply pipe configured to link said discharge unit and said processing solution supply source;

a discharge pump provided at said supply pipe;

a supply pump provided at a supply pipe between said discharge pump and said processing solution supply source;

a control unit configured to control operation of said discharge pump and supply pump;

a filter provided at a supply pipe between said discharge pump and said supply pump;

a branch pipe provided at a supply pipe between said supply pump and said processing solution supply source;

a vent pipe configured to link said filter and said branch pipe;

a vent-side three-way valve provided at said vent pipe and configured to allow said filter to communicate with said branch pipe or a waste solution pipe; and a switch unit configured to switch said vent-side three-way valve.

3. A processing solution supply apparatus comprising:

a discharge unit configured to discharge a processing solution onto a substrate;

a processing solution supply source configured to store the processing solution;

a supply pipe configured to link said discharge unit and said processing solution supply source;

a discharge pump provided at said supply pipe;

a supply pump provided at a supply pipe between said discharge pump and said processing solution supply source;

a control unit configured to control operation of said discharge pump and supply pump;

a filter provided at a supply pipe between said discharge pump and said supply pump;

a branch pipe provided at a supply pipe between said supply pump and said processing solution supply source;

a purge pipe configured to link said discharge pump and said branch pipe;

a purge-side three-way valve provided at said purge pipe and configured to allow said discharge pump to communicate with said branch pipe or a waste solution pipe; and a switch unit configured to switch said purge-side three-way valve.

4. A processing solution supply apparatus comprising:

a discharge unit configured to discharge a processing solution onto a substrate;

a processing solution supply source configured to store the processing solution;

a supply pipe configured to link said discharge unit and said processing solution supply source;

a discharge pump provided at said supply pipe;

a supply pump provided at a supply pipe between said discharge pump and said processing solution supply source;

a control unit configured to control operation of said discharge pump and supply pump;

a filter provided at a supply pipe between said discharge pump and said supply pump;

a branch pipe provided at a supply pipe between said supply pump and said processing solution supply source;

a vent pipe configured to link said filter and said branch pipe;

a first three-way valve provided at said vent pipe and configured to allow said filter to communicate with said branch pipe or a waste solution pipe;

a switch unit configured to switch said first three-way valve;

a purge pipe configured to link said discharge pump and said branch pipe;

a second three-way valve provided at said purge pipe and configured to allow allowing said discharge pump to communicate with said branch pipe or a waste solution pipe; and a switch unit configured to switch said second three-way valve.

5. A processing solution supply apparatus comprising:

a discharge unit configured to discharge a processing solution onto a substrate to be processed;

a processing solution supply source configured to store the processing solution;

a supply pipe configured to link said discharge unit and said processing solution supply source;

a pump configured to supply the processing solution from said processing solution supply source to said discharge unit;

a filter inserted in a supply pipe between said pump and said discharge unit;

a by-pass pipe configured to link said filter and a supply pipe on the upstream side of said pump;

a waste solution pipe branching out from said by-pass pipe; and a switching valve configured to switch the processing solution in said by-pass pipe either to the upstream side of said pump or said waste solution pipe.

6. The apparatus as set forth in claim 5, further comprising:

a control section configured to control operation timing of said pump and switching valve.

7. A processing solution supply apparatus comprising:

a discharge unit configured to discharge a processing solution onto a substrate;

a processing solution supply source configured to store the processing solution;

a supply pipe configured to link said discharge unit and said processing solution supply source;

a pump configured to supply the processing solution from said processing solution supply source to said discharge unit;

a filter inserted in a supply pipe between said processing solution supply source and said pump;

a by-pass pipe configured to link said pump and a supply pipe on the upstream side of said filter;

a waste solution pipe branching out from said by-pass pipe; and a switching valve configured to switch the processing solution in said by-pass pipe either to the upstream side of said filter or said waste solution pipe.

8. The apparatus as set forth in claim 7, further comprising:

a control section configured to control operation timing of said pump and switching valve.

9. A processing solution supply apparatus comprising:

a discharge unit configured to discharge a processing solution onto a substrate;

a processing solution supply source configured to store the processing solution;

a supply pipe configured to link said discharge unit and said processing solution supply source;

a pump configured to supply the processing solution from said processing solution supply source to said discharge unit;

a filter inserted in a supply pipe between said processing solution supply source and said pump;

a first by-pass pipe configured to link said filter and a supply pipe on the upstream side of said pump;

a first waste solution pipe branching out from said first by-pass pipe;

a first switching valve configured to switch the processing solution in said first by-pass pipe either to the upstream side of said pump or said first waste solution pipe;

a second by-pass pipe configured to link said pump and a supply pipe on the upstream side of said filter;

a second waste solution pipe branching out from said second by-pass pipe; and a second switching valve configured to switch the processing solution in said second by-pass pipe either to the upstream side of said filter or said second waste solution pipe.

10. The apparatus as set forth in claim 9, further comprising:

a control section configured to control operation timings of said pump, said first switching valve and said second switching valve.

11. A processing solution supply apparatus comprising:

a discharge unit configured to discharge a processing solution onto a substrate to be processed;

a processing solution supply source configured to store the processing solution;

a supply pipe configured to link said discharge unit and said processing solution supply source;

a pump provided at said supply pipe;

a control unit configured to control operation of said pump;

a branch pipe provided at a supply pipe between said processing solution supply source and said pump;

a by-pass pipe configured to link said pump and said branch pipe;

a return pipe branching out from said by-pass pipe, for linking between said by-pass pipe and said processing solution supply source;

a first three-way valve provided at said by-pass pipe and configured to allow said pump to communicate with said by-pass pipe or said return pipe;

a switch unit configured to switch said first three-way valve;

a second three-way valve provided between said first three-way valve and said branch pipe and configured to allow said first three-way valve to communicate with said by-pass pipe or a waste solution pipe; and a switch unit configured to switch said second three-way valve.

12. A processing solution supply apparatus comprising:

a discharge unit configured to discharge a processing solution onto a substrate;

a processing solution supply source configured to store the processing solution;

a supply pipe configured to link said discharge unit and said processing solution supply source;

a discharge pump provided at said supply pipe;

a supply pump provided at a supply pipe between said discharge pump and said processing solution supply source;

a control unit configured to control operation of said discharge pump and supply pump;

a filter provided at a supply pipe between said discharge pump and said supply pump;

a branch pipe provided at a supply pipe between said supply pump and said processing solution supply source;

a vent pipe configured to link said filter and said branch pipe;

a purge pipe configured to link said discharge pump and said branch pipe;

a return pipe branching out from said vent pipe and said purge pipe respectively, for linking between said vent pipe and said purge pipe, and said processing solution supply source;

a vent-side three-way valve provided at said vent pipe and configured to allow said filter to communicate with said branch pipe or said return pipe;

a switch unit configured to switch said vent-side three-way valve;

a purge-side three-way valve provided at said purge pipe and configured to allow said discharge pump to communicate with said branch pipe or said return pipe;

a switch unit configured to switch said purge-side three-way valve;

a vent-side switching valve provided at said vent pipe and configured to allow said vent-side three-way valve and said branch pipe to communicate together, allow said vent-side three-way valve and said waste solution pipe to communicate together, or allow said branch pipe and said waste solution pipe to communicate together;

a switch unit configured to switch said vent-side switching valve;

a purge-side switching valve provided at said purge pipe and configured to allow said purge-side three-way valve and said branch pipe to communicate together, allow said purge-side three-way valve and said waste solution pipe to communicate together, or allow said branch pipe and said waste solution pipe to communicate together;

a switch unit configured to switch said purge-side three-way valve; and a processing solution removing unit provided at said branch pipe and configured to remove the processing solution in said branch pipe, said supply pipe, said vent pipe, and said purge pipe.

13. The apparatus as set forth in claim 12, further comprising:

a detecting unit provided between said filter and said vent-side three-way valve and configured to detect bubbles on the vent side.

14. The apparatus as set forth in claim 12, further comprising:

a detecting unit provided between said discharge pump and said purge-side three-way valve and configured to detect bubbles on the purge side.

15. The apparatus as set forth in claim 12, further comprising:

a vent-side bubble detecting unit provided between said filter and said vent-side three-way valve and configured to detect bubbles on the vent side;

a purge-side bubble detecting unit provided between said discharge pump and said purge-side three-way valve and configured to detect bubbles on the purge side; and a control unit configured to separately switch said vent-side three-way valve, said purge-side three-way valve, said vent-side switching valve, and said purge-side switching valve at predetermined timing based on the detection of existence of bubbles in said vent pipe and said purge pipe by said vent-side bubble detecting unit and said purge-side bubble detecting unit.

16. The apparatus as set forth in claim 14, further comprising:

a vent-side vibrator provided between said filter and said vent-side bubble detecting unit.

17. The apparatus as set forth in claim 14, further comprising:

a purge-side vibrator provided between said discharge pump and said purge-side bubble detecting unit.

* * * * *